United States Patent [19]

Hata

[11] Patent Number: 5,041,871

[45] Date of Patent: Aug. 20, 1991

[54] CLAM SHELL TYPE IMAGE FORMING APPARATUS

[75] Inventor: Masayuki Hata, Hachioji, Japan

[73] Assignee: Konica Corporation, Tokyo, Japan

[21] Appl. No.: 601,998

[22] Filed: Oct. 23, 1990

[30] Foreign Application Priority Data

Oct. 24, 1989 [JP] Japan ..... 1-276688
Oct. 24, 1989 [JP] Japan ..... 1-276689

[51] Int. Cl.[5] ..... G03G 15/00; G03G 15/14; G03G 15/20

[52] U.S. Cl. ..... 355/200; 355/271; 355/282; 355/210

[58] Field of Search ..... 355/200, 282, 271, 275, 355/212

[56] References Cited

U.S. PATENT DOCUMENTS

| | | | |
|---|---|---|---|
| 4,556,308 | 12/1985 | Hoppner et al. | 355/200 |
| 4,588,280 | 5/1986 | Ogawa et al. | 355/200 |
| 4,634,264 | 1/1987 | Takahashi | 355/200 |
| 4,641,947 | 2/1987 | Ishida et al. | 355/200 |
| 4,668,072 | 5/1987 | Yasuda | 355/200 X |
| 4,788,572 | 11/1988 | Slayton et al. | 355/326 X |
| 4,814,817 | 3/1989 | Nishijima et al. | 355/200 |
| 4,876,572 | 10/1989 | Nagatsuna | 355/200 X |
| 4,926,219 | 5/1990 | Hirasawa et al. | 355/200 X |
| 4,974,033 | 11/1990 | Yamada et al. | 355/200 X |

FOREIGN PATENT DOCUMENTS

| | | | |
|---|---|---|---|
| 0101549 | 6/1985 | Japan | 355/200 |
| 0102649 | 6/1985 | Japan | 355/200 |
| 2103151 | 2/1983 | United Kingdom | 355/200 |

*Primary Examiner*—A. T. Grimley
*Assistant Examiner*—Nestor R. Ramirez
*Attorney, Agent, or Firm*—Jordan B. Bierman

[57] ABSTRACT

An image recording apparatus divided into an upper portion and a lower portion. The photosensitive drum is in the upper portion, and the transfer belt unit and photographic fixing unit are on a unit mount plate in the lower portion. Protrusions are provided in the lower portion to position the unit mount plate and the transfer belt unit and photographic fixing unit which it carries. A spring member is also provided on the upper portion in a position corresponding to the photographic fixing unit.

As a result, the mount plate is so positioned on the lower portion that, when the upper and lower portions are closed, the photographic fixing unit is pushed down by the spring member and the transfer belt unit is pushed down by the photosensitive drum.

3 Claims, 2 Drawing Sheets

CLAM SHELL TYPE IMAGE FORMING APPARATUS

BACKGROUND OF THE INVENTION

1. Field of the Invention

The present invention relates to an image recording apparatus whose body can be divided into two hinged upper and lower portions.

2. Description of the Prior Art

There are known image recording apparatus such as an electrophotographic copying machine or a printer utilizing an electrophotographic process to record an image, a body of which apparatus can be divided into upper and lower portions in order to easily remove a so-called jammed paper i.e. recording papers are jammed inside the apparatus, during recording operation.

In such kind of image recording apparatus, and in particular, image recording apparatus for recording color images, a transfer belt unit is used to assure that color visible images formed on a photosensitive drum is more positively transferred onto a recording paper. In a conventional apparatus, this transfer belt unit is secured to the lower portion of the apparatus body, together with a photographic fixing unit by screws. For this reason, in the time of maintenance and inspection, in order to exchange the units, the units must be remoted from the apparatus body in good order by unscrewing the screws, which results in very cumbersome work for exchanging the units.

SUMMARY OF THE INVENTION

Accordingly, it is an object of the present invention to provide an image recording apparatus in which the aforenoted disadvantages encountered with the prior art can be eliminated.

More specifically, it is an object of the present invention to provide an image recording apparatus in which a transfer belt unit and a photographic fixing unit can be exchanged with ease upon maintenance and inspection.

In accordance with a first aspect of the present invention, an image recording apparatus is arranged such that positioning protrusions for positioning a transfer belt unit and a photographic fixing unit are formed on a lower portion of an apparatus body which can be divided into two upper and lower portions. When the transfer belt portion and the photographic fixing unit are properly positioned by the positioning protrusions and the upper portion of the apparatus body is pushed downward so as to become unitary with the lower portion, the photographic fixing unit is pushed by a spring member provided on the upper portion and the transfer belt unit is pushed by a photosensitive drum.

As a second aspect of the present invention, an image recording apparatus is comprised of protrusions formed on a lower portion of an apparatus body which can be divided into two upper and lower portions and an attaching plate on which a transfer belt unit and a photographic fixing unit are attached beforehand. When this attaching plate is positioned on the lower portion of the apparatus body by the positioning protrusions and the upper portion of the apparatus body is pushed downward so as to become unitary with the lower portion, the photographic fixing unit is pushed by a spring member provided on the upper portion and the transfer belt unit is pushed by a photosensitive drum.

The preceding, and other objects, features and advantages of the present invention will be apparent in the following detailed description of illustrative embodiments to be taken in conjunction with the accompanying drawings, in which like reference numerals are used to identify the same or similar parts in the several views.

DETAILED DESCRIPTION OF THE PREFERRED EMBODIMENTS

The present invention will hereinafter be described with reference to the accompanying drawings.

Figure 1:
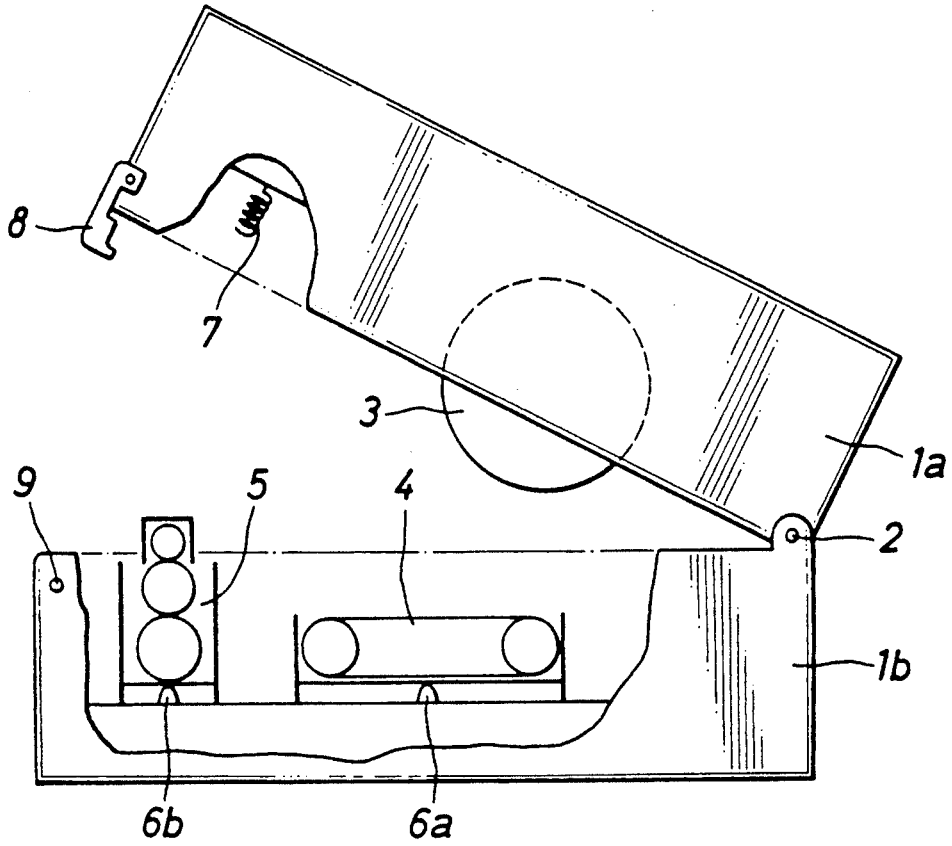
FIG. 1, is a schematic diagram showing the image recording apparatus according to a first embodiment of the present invention, with the body divided into upper and lower portions.
Figure 2:
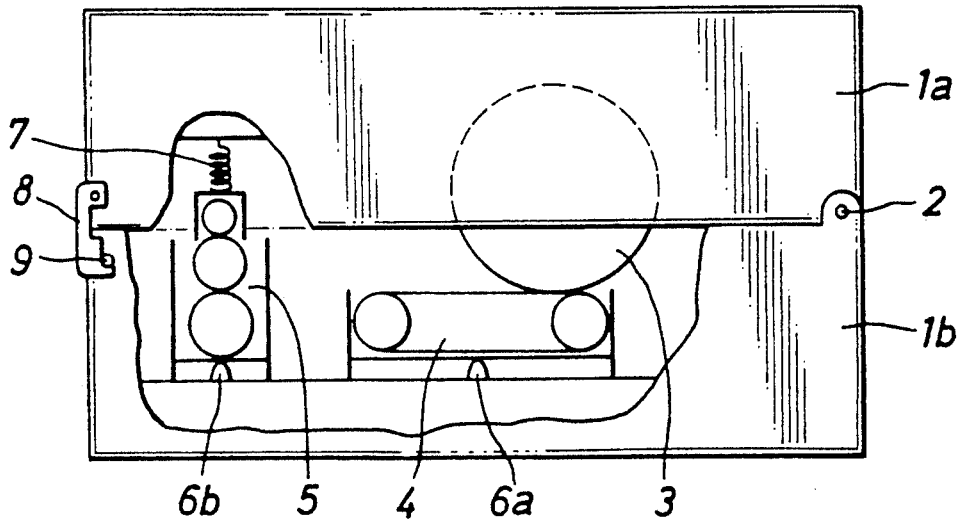
FIG. 2 is a schematic diagram showing the same image recording apparatus of FIG. 1 with the upper and lower portions unified.

FIGS. 1 and 2 show the first embodiment of the image recording apparatus according to the present invention.

As shown in the drawings, an apparatus body can be divided into an upper portion 1*a* and a lower portion 1*b* hinged with each other by a hinge 2. Though not shown fully, a photosensitive drum 3, a charging electrode, a developing device, a separating electrode, a cleaning means and so on are mounted on the upper portion 1*a* and on the peripheral portion thereof. On the other hand, the lower portion 1*b* has a transfer belt unit 4 and a photographic fixing unit 5 attached thereto. The transfer belt unit 4 and the photographic fixing unit 5 are positioned by positioning protrusions 6*a* and 6*b* and mounted on the lower portion 1*b*. The upper portion 1*a* of the apparatus body has a spring 7 provided as its position corresponding to the photographic fixing unit 5.

When the upper portion 1*a* and the lower portion 1*b* of the thus arranged image recording apparatus are assembled as a unitary body, the upper portion 1*a* is pushed downward so as to become a unitary body with the lower portion 1*b* and a hook 8 provided on the upper portion 1*a* is engaged with a pin 9 provided on the lower portion 1*b*. This results in that the photographic fixing unit 5 is pushed downward by the spring 7 and the transfer belt unit 4 is pushed by the photosensitive drum 3. When the upper portion 1*a* and the lower portion 1*b* are assembled as a unitary body as described above, the transfer belt unit 4 and the fixing unit 5 ar both stabilized on the lower portion 1*b* with the result that no trouble occurs in the recording operation.

Upon maintenance and inspection, when the hook 8 is disengaged from the pin 9 and the upper portion 1*a* is lifted upward by a spring (not shown), the transfer belt unit 4 and the photographic fixing unit 5 are made free from being pushed downward. Therefore, these units 4 and 5 can be removed from the lower portion 1*b* only by pulling them upward. Accordingly, when new transfer belt unit 4 and photographic fixing unit 5 are properly positioned by and inserted into the positioning protrusions 6*a* and 6*b*, these new units 4 and 5 are accurately mounted on the lower portion 1*b* at its predetermined positions. In this fashion, the transfer belt unit 4 and the photographic fixing unit 5 can be exchanged with ease.

Figure 3:
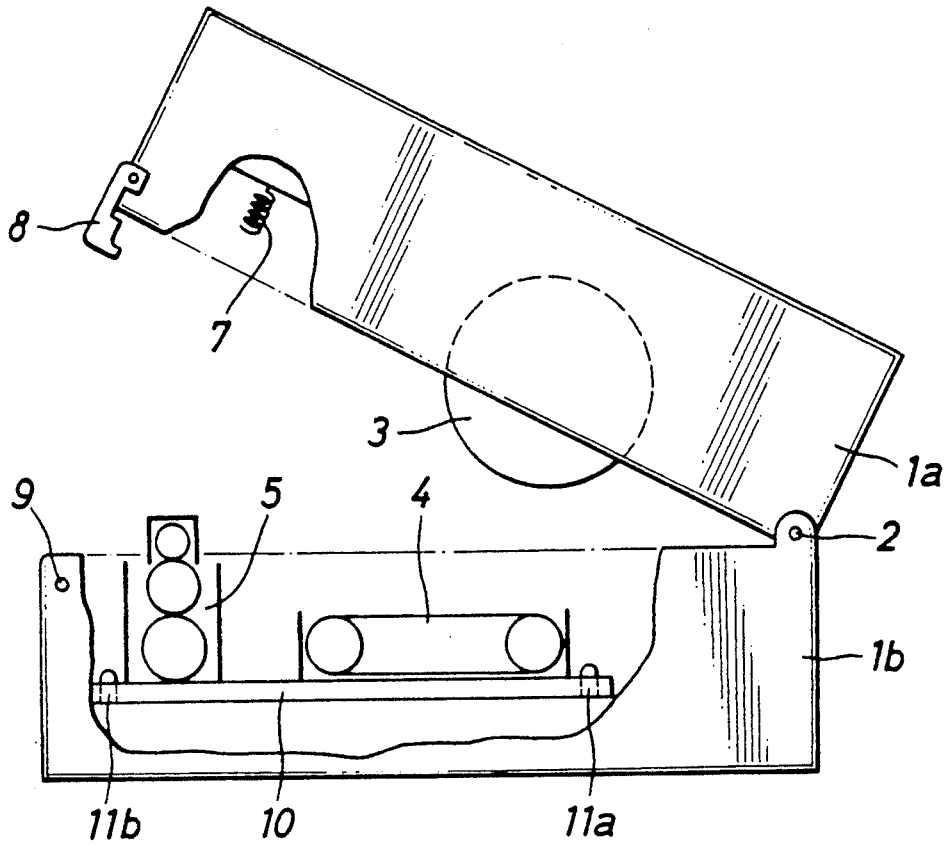
FIG. 3 is a schematic diagram of the image recording apparatus according to a second embodiment of the present invention with the body divided into upper and lower portions.
Figure 4:
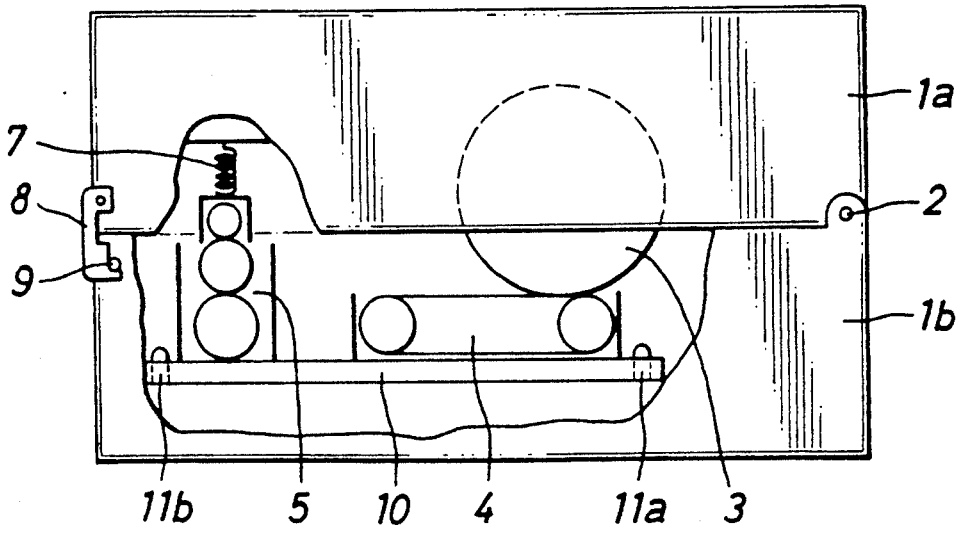
FIG. 4 is a schematic diagram of the same image recording apparatus of FIG. 3 with the upper and lower portions unified.

FIGS. 3 and 4 show the second embodiment of the image recording apparatus according to the present invention. FIG. 3 shows the image recording apparatus with the upper and lower portions divided and FIG. 4 shows the same with the two portions assembled as a unitary body.

A fundamental construction of the image recording apparatus according to the second embodiment of the present invention is the same as that of the image recording apparatus of FIGS. 1 and 2. In FIGS. 3 and 4, therefore like parts corresponding to those of FIGS. 1 and 2 are marked with the same reference numerals and therefore need not be described.

The image recording apparatus of the second embodiment of the present invention is different from that of the first embodiment only in that the transfer belt unit 4 and the photographic fixing unit 5 are attached to the lower portion 1*b* by means of a single unit mount plate 10. As shown in FIGS. 3 and 4, the transfer belt unit 4 and the photographic fixing unit 5 are mounted beforehand on the unit mount plate 10, and this unit mount plate 10 is positioned by positioning protrusions 11*a* and 11*b* formed on the upper surface of the lower portion 1*b* and then mounted on the lower portion 1*b*. The upper portion 1*a* of the apparatus body has the pushing spring 7 provided at its position corresponding to the photographic fixing unit 5.

When the upper portion 1*a* and the lower portion 1*b* of the thus arranged image recording apparatus are assembled as a unitary body, the upper portion 1*a* is pushed downward so as to become a unitary body with the lower portion 1*b* and the hook 8 provided on the upper portion 1*a* is engaged with the pin 9 provided on the lower portion 1*b*. The photographic fixing unit 5 is pushed downward by the spring 7 and the transfer belt unit 4 is pushed by the photosensitivie drum 3. When the upper portion 1*a* and the lower portion 1*b* are assembled as a unitary body as described above, the transfer belt unit 4 and the photographic fixing unit 5 are both stabilized with the result that no trouble occurs in recording operation.

Upon maintenance and inspection, the hook 8 is disengaged from the pin 9, and the upper portion 1*a* is lifted upward and the unit mount plate 10 is pulled upward from the lower portion 1*b*, then the transfer belt unit 4 and the photographic fixing unit 5 can be removed together from the lower portion 1*b*. Accordingly, when a new unit mount plate 10 on which a new transfer belt unit 4 and a new photographic fixing unit 5 are mounted beforehand is inserted into the positioning protrusions 11*a* and 11*b*, the new unit mount plate 10 can be accurately mounted on the lower portion 1*b* at its predetermined position. In this fashion, the transfer belt unit 4 and the photographic fixing unit 5 can be exchanged with ease.

While the unit mount plate 10 is provided independently of the transfer belt unit 4 and the fixing unit 5 in the aforementioned second embodiment, the unit mount plate 10 may be formed of a portion of a mounting member of the transfer belt unit 4 or of the photographic fixing unit 5.

According to the first embodiment of this invention, the positioning protrusions for positioning the transfer belt unit and the photographic fixing unit are formed on the lower portion of the apparatus body which can be divided into upper and lower portions. When the transfer belt portion and the photographic fixing unit are positioned by the positioning protrusions and the upper portion of the apparatus body is pushed downward so as to become unitary with the lower portion, the photographic fixing unit is pushed by the spring member provided on the upper portion and the transfer belt unit is pushed by the photosensitive drum. Therefore, upon maintenance and inspection, the transfer belt unit and the photographic fixing unit can be removed from the lower portion only by lifting the upper portion and by pulling the transfer belt unit and the photographic fixing unit from the positioning protrusions, thus making it possible to exchange the transfer belt unit and the photographic fixing unit with ease.

According to the second embodiment of the present invention, positioning protrusions are formed on the lower portion of the apparatus body which can be divided into two portions and the transfer belt unit and the photographic fixing unit are mounted beforehand on the unit mount plate. When this mount plate is positioned on the lower portion of the apparatus body by the positioning protrusions and the lower portion of the apparatus body is pushed downward so as to become unitary with the lower portion, the photographic fixing unit is pushed by a spring member provided on the upper portion and the transfer belt unit is pushed by the photosensitive drum. Thus, upon maintenance and inspection, the unit mount plate to which the transfer belt unit and the photographic fixing unit are attached is upwardly pulled out from the positioning protrusions by lifting the upper portion of the apparatus body and instead of the old unit mount plate, a new unit mount plate on which a new transfer belt unit and a new photographic fixing unit are mounted is positioned by an inserted into the positioning protrusions, thereby the transfer belt unit and the photographic fixing unit being exchanged with ease.

Having described preferred embodiments of the invention with reference to the accompanying drawings, it is to be understood that the invention is not limited to those precise embodiments and that various changes and modifications thereof could be effected by one skilled in the art without departing from the spirit or scope of the invention as defined in the appended claims.

What we claim:

1. An image recording apparatus whose body can be divided into an upper portion and a lower portion, comprising;

(1) a photosensitive drum arranged on said upper portion;

(2) a transfer belt unit and a photographic fixing unit arranged on a unit mount plate;

(3) positioning protrusions provided on said lower portion for positioning said unit mount plate; and (4) a spring member provided on said upper portion at is position corresponding to said photographic fixing unit;

wherein said unit mount plate is positioned on said lower portion by said positioning protruding members and said upper portion and said lower portion are coupled to provide a unitary body, said photographic fixing unit is pushed down by said spring member and said transfer belt unit is pushed down by said photosensitive drum.

2. The image recording apparatus according to claim 1, wherein said unit mount plate is easily detachably mounted on said lower portion in the vertical direction.

3. The image recording apparatus according to claim 1, further comprising a pin provided on one of said upper and lower portions and a hook provided on the other of said upper and lower portions so as to be engage with said pin.

* * * * *